US005800678A

United States Patent [19]

Pitkäjärvi

[11] Patent Number: 5,800,678

[45] Date of Patent: Sep. 1, 1998

[54] METHOD AND DEVICE FOR REGULATING A FLOW OF DILUTION LIQUID IN CONNECTION WITH A HEADBOX OF A PAPER/BOARD MACHINE

[75] Inventor: Kari Pitkäjärvi, Jyväskylä, Finland

[73] Assignee: Valmet Corporation, Helsinki, Finland

[21] Appl. No.: 775,773

[22] Filed: Dec. 31, 1996

[30] Foreign Application Priority Data

Oct. 23, 1996 [FI] Finland ..... 964261

[51] Int. Cl.[6] ..... D21F 1/08; D21H 23/06

[52] U.S. Cl. ..... 162/199; 162/202; 162/212; 162/216; 162/258

[58] Field of Search ..... 162/202, 212, 162/216, 258, 336, 338, 252, 199, 341, 198; 251/160, 310, 180, 181, 183

[56] References Cited

U.S. PATENT DOCUMENTS

| | | | |
|---|---|---|---|
| 2,471,941 | 5/1949 | Downey | 251/310 X |
| 2,506,098 | 5/1950 | Melichar | 251/310 X |
| 2,558,260 | 6/1951 | Maky | 251/310 X |
| 2,580,218 | 12/1951 | Conant | 251/310 |
| 3,516,638 | 6/1970 | Piggott | 251/310 X |
| 4,044,995 | 8/1977 | Kubota | 251/310 X |
| 4,809,949 | 3/1989 | Rakieski | 251/310 |
| 5,490,905 | 2/1996 | Huovila et al. | 162/212 |
| 5,545,293 | 8/1996 | Huovila et al. | 162/212 |

FOREIGN PATENT DOCUMENTS

| | | |
|---|---|---|
| 811619 | 12/1981 | Finland . |
| 901593 | 10/1991 | Finland . |
| 92228 | 6/1994 | Finland . |
| 2078343 | 1/1982 | United Kingdom . |

*Primary Examiner*—Stanley S. Silverman
*Assistant Examiner*—Jose A. Fortuna
*Attorney, Agent, or Firm*—Steinberg & Raskin, P.C.

[57] ABSTRACT

A system for combining a dilution flow with the stock flow passed from the inlet header of the headbox of a paper/board machine. The equipment comprises a valve which regulates the dilution flow and which consists of a valve housing, of a spindle, and of a flow duct placed in the spindle, which flow duct can be rotated into different regulation positions for the purpose of regulating the dilution flow departing from the valve. One end opening of the flow duct and the flow opening in the valve housing are placed in alignment with one another irrespective of the position of rotation of the spindle. The position of the other end opening of the duct placed in the spindle in relation to the flow opening in the valve housing can be regulated by rotating the spindle.

17 Claims, 6 Drawing Sheets

METHOD AND DEVICE FOR REGULATING A FLOW OF DILUTION LIQUID IN CONNECTION WITH A HEADBOX OF A PAPER/BOARD MACHINE

FIELD OF THE INVENTION

The invention relates generally to an arrangement for combining a flow of dilution liquid with a stock flow being passed from an inlet header of a paper/board machine and more particularly to an apparatus for regulating a flow of the dilution liquid in connection with a headbox of a paper/board machine.

The invention also relates to a method for regulating or adjusting the flow of stock in a headbox of a paper/board machine when a dilution liquid is introduced into the stock flow.

BACKGROUND OF THE INVENTION

From the current assignee's Finnish Patent Application Nos. 901593, 933027 and 942780 (the latter two applications correspond to U.S. Pat. No. 5,545,293, the entire specification of which is incorporated by reference herein) of earlier dates, a so-called dilution headbox is known, which is understood at this time by those skilled in the art to connote a headbox construction in which the basis weight or grammage of the web can be regulated across the width of the web by through valves passing dilution flows to different areas of width of the headbox and by regulating the quantities of these flows. The dilution flow is mixed with the stock flow passed out of the inlet header of the headbox. The dilution flow can consist of clean or fibrous water. For example, the dilution water can be wire water taken from the web as retention.

OBJECTS AND SUMMARY OF THE INVENTION

It is an object of the present invention to provide a new and improved dilution headbox which regulates the basis weight of the web across the width of the web.

It is another object of the invention to provide a new and improved valve for use, e.g., in connection with a dilution headbox for regulating the flow of dilution liquid to be passed into the stock flow.

It is another object of the invention to provide a new method for regulating or adjusting the flow of dilution liquid into the flow lines in a headbox of a paper/board machine, e.g., to affect the consistency thereof.

In order to achieve these objects and others, according to the invention, such a valve construction is used for regulation of the dilution flow including a valve spindle which is rotatable by means of an electric motor, preferably a stepping motor, in its valve housing so that an end of a curved dilution-liquid flow duct in the valve spindle is displaced into different covering positions against an aligned end of an adjacent duct or equivalent. The valve construction in accordance with the invention comprises a duct placed in the valve spindle, and the end of the duct, preferably the end which constitutes an inlet end of the duct, is placed on the axis of rotation of the valve, whereas the position of the other end, preferably the outlet end, of the duct is changed in relation to the corresponding flow opening in the valve housing. Further, in certain embodiments, in the valve construction in accordance with the invention, loading members, preferably springs, are used, by whose means the spindle can be pressed tightly against its opposed backup face in the spindle cavity in the valve housing. In such a case, the end openings of the flow duct in the spindle are placed tightly against their backup faces, whereby detrimental leakage of dilution liquid between the spindle and the walls of the spindle cavity in the valve housing are prevented. In this manner, the valve remains clean very well.

A novel construction is also described for regulating the dilution flow. In the construction in accordance with the invention, the stock inlet header and the dilution flow inlet header are preferably placed one above the other, so that the chambers of the inlet headers are separated by a common partition wall. Further, in the construction in accordance with the invention, a distribution plate common of the flows is used. The dilution flow is passed from its inlet header to the valve and further from the valve through a duct placed in the distribution plate and becoming narrower towards its end into the flow pipes of the stock passed from the stock inlet header, so that, by means of the narrowing duct, the dilution flow is divided in the desired way, preferably uniformly, into each pipe in the vertical row concerned.

In a most basic embodiment of the arrangement for combining a dilution flow with a stock flow being passed from an inlet header of a headbox of a paper/board machine in accordance with the invention, the valve for regulating the dilution flow comprises a valve housing having a first flow opening and a second flow opening and a spindle having a flow duct having a first flow opening and a second flow opening, and rotation means arranged in connection with the spindle for rotating the spindle. The spindle is arranged in the valve housing such that upon rotation of the spindle by the rotation means, the first flow opening of the flow duct in the spindle is continuously in alignment with the first flow opening of the valve housing irrespective of the position of rotation of the spindle in the valve housing and the second flow opening of the flow duct of the spindle is moved into different positions in relation to the second flow opening in the valve housing. In this manner, it is possible to obtain a variable dilution flow through the valve. In certain embodiments, the first flow opening of the flow duct of the spindle is an inlet opening of the dilution flow and the second flow opening of the flow duct of the spindle is an outlet opening of the dilution flow whereby the dilution flow is directed through the flow duct of the spindle from the first flow opening to the second flow opening. The first flow opening of the flow duct of the spindle may be situated in a fixed position relative to the first flow opening in the valve housing and the spindle rotated by the rotation means about an axis of rotation. The first flow opening of the flow duct of the spindle and the first flow opening in the valve housing may each have a central axis coincident with the axis of rotation of the spindle. In some embodiments, the spindle is arranged in the valve housing such that a central axis of the outlet flow opening of the spindle is always at an oblique angle with respect to the outlet flow opening in the valve housing during flow of a dilution liquid through the spindle.

With respect to other features of the arrangement, it may include a tube bank situated downstream in a flow direction from the inlet header and including a plurality of horizontally and vertically aligned tubes, a distribution plate interposed between the inlet header and the tube bank and including a plurality of pipes whereby each pipe of the distribution plate is aligned with a respective one of the tubes of the tube bank. The distribution plate includes a plurality of narrowing ducts, each fluidly coupled to a respective vertical column of the pipes in the distribution plate, and the narrowing ducts are structured and arranged to distribute a uniform amount of fluid into each of the pipes in the respective vertical column. The arrangement thus includes a plurality of valves to enable cross-machine direction basis weight profile regulation and the valves are arranged in connection with the distribution plate. An intermediate flow duct can be arranged between the outlet flow opening of each valve and the respective narrowing duct. Further, the arrangement can include a dilution header for delivering the dilution flow, and an inlet plate interposed between the dilution header and the valve whereby the inlet plate includes a pipe fluidly coupled to the dilution header and the inlet flow opening of the valve is open to the pipe in the inlet plate.

The method for adjusting a stock flow in a headbox of a paper/board machine comprises the steps of passing the stock flow from an inlet header through pipes in a distribution plate, directing the dilution flow from a dilution header through a valve into the pipes through which the stock flows passes in the distribution plate, and regulating the dilution flow by rotating a spindle in a housing of the valve such that a inlet flow opening of a flow duct in the spindle is continuously in alignment with an inlet flow opening of the valve housing irrespective of the position of rotation of the spindle in the valve housing and an outlet flow opening of the flow duct of the spindle is moved into different positions in relation to an outlet flow opening in the valve housing. Leakage in the valve may be prevented by pressing the spindle against at least one face of a spindle cavity in the valve housing in which the spindle is situated such that the flow openings of the flow duct of the spindle are pressed tightly against a respective opposed face of the spindle cavity.

The invention will be described in the following with reference to some preferred embodiments of the invention illustrated in the figures in the drawings. However, the invention is not confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1A:
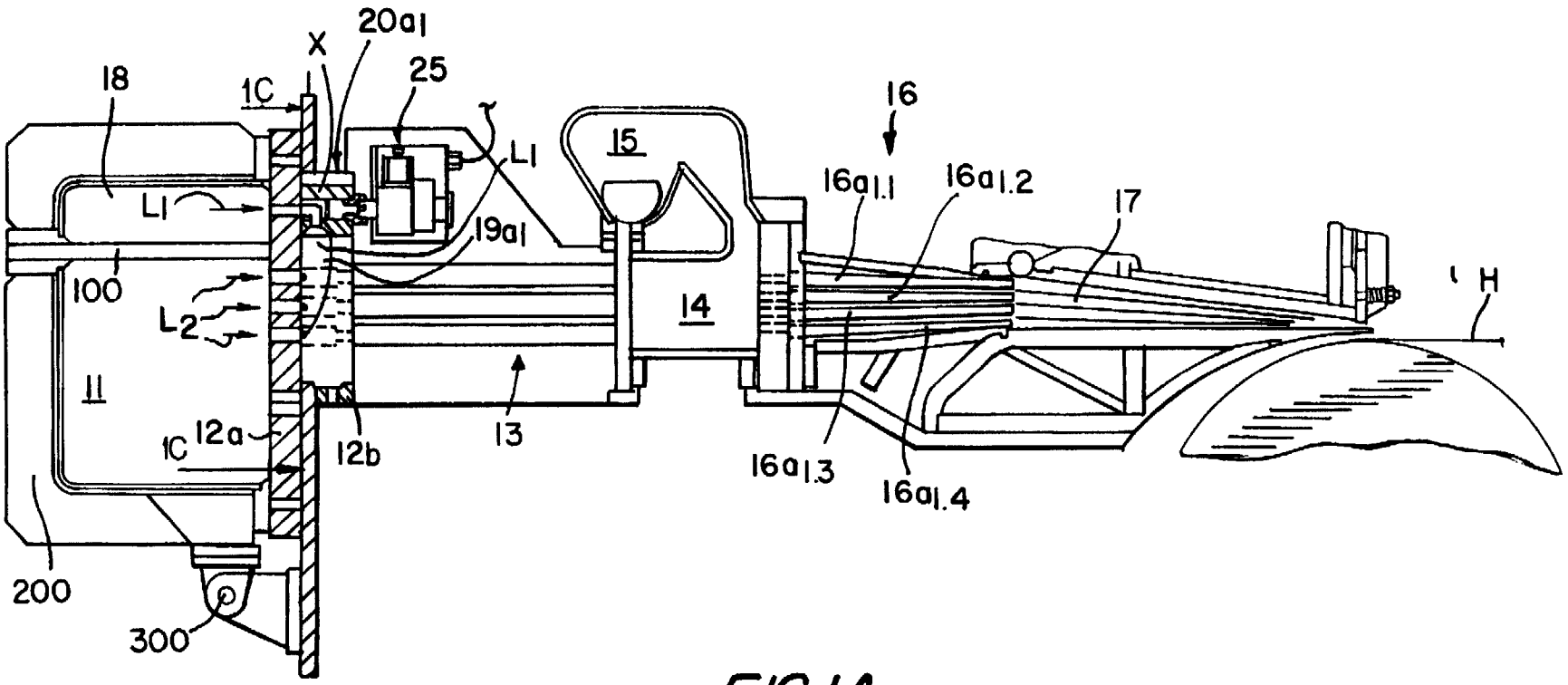
FIG. 1A is a longitudinal sectional view of a headbox of a paper machine.
Figure 1B:
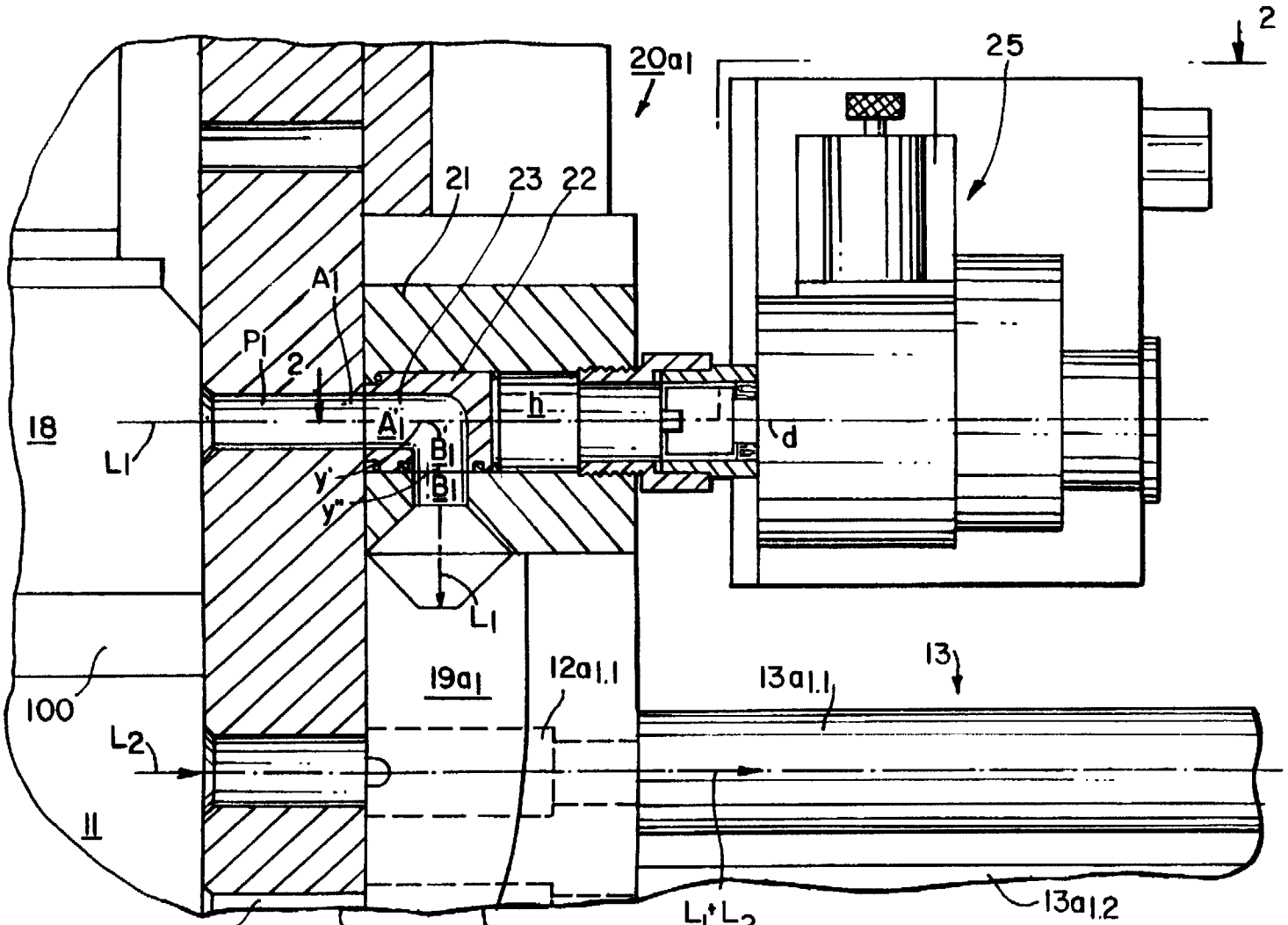
FIG. 1B shows the area X of FIG. 1A on an enlarged scale.
Figure 1C:
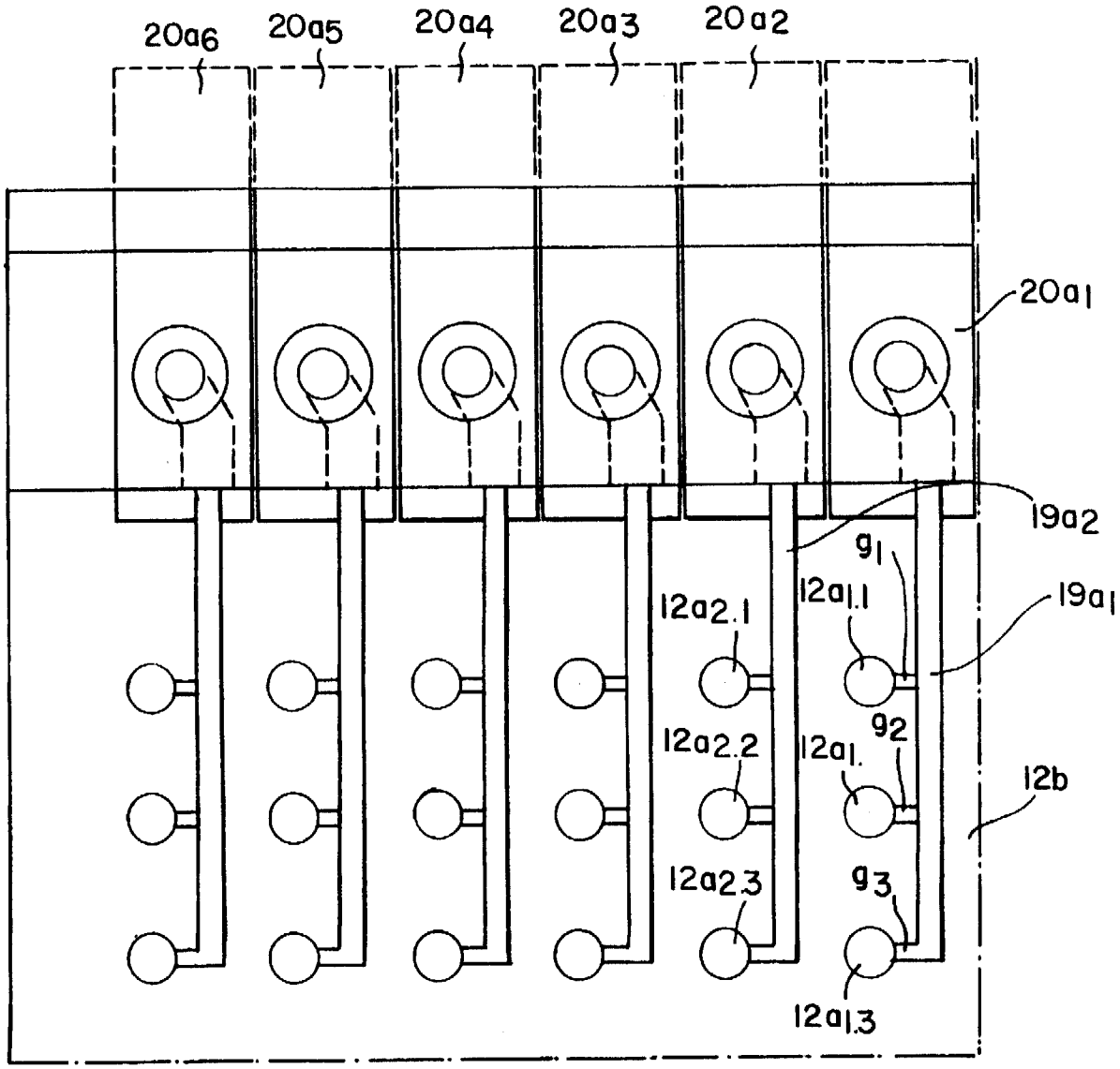
FIG. 1C is a sectional view taken along the line 1C—1C in FIG. 1A.

Referring to the accompanying drawings wherein the same reference numerals refer to the same or similar elements, as shown in FIG. 1A, a headbox 10 comprises an inlet header 11 from which a stock flow $L_2$ is passed through an inlet plate 12*a* into a bank of tubes or a tube manifold 13. After the inlet plate 12*a* and before the tube manifold 13 in the flow direction, there is a distribution plate 12*b*. Both plates 12*a* and 12*b* comprise conduits or pipes $12a_{1.1}$, $12a_{1.2}$ . . . , $12a_{2.1}$,$12a_{2.2}$ . . . placed in vertical columns and horizontal rows (FIG. 1B). The distribution plate 12*b* also includes a plurality of narrowing ducts $19a_1$,$19a_2$ . . . which are formed into it and out of which a plurality of branch ducts $g_1$,$g_2$ . . . open into a respective vertically situated one of the pipes in each column $12a_{1.1}$,$12a_{1.2}$,$12a_{1.3}$ . . . (FIG. 1C). The pipes $12a_{1.1}$,$12a_{1.2}$ . . . , $12a_{2.1}$,$12a_{2.2}$ . . . in the distribution plate 12*b* are fluidly connected with a respective one of a plurality of tubes $13a_{1.1}$,$13a_{1.2}$ . . . placed in corresponding, aligned locations in the tube manifold 13, and the stock flow $L_1+L_2$ is passed from the tube manifold 13 further into an intermediate chamber 14 which is opened from above into an equalizing chamber 15. From the intermediate chamber 14, the stock flow is passed into a second bank of tubes, which in the illustrated embodiment constitutes a turbulence generator 16, into connection with a plurality of pipes $16a_{1.1}$,$16a_{1.2}$ . . . , $16a_{2.1}$,$16a_{2.2}$ . . . thereof and further through the pipes in the turbulence generator 16 into a slice duct 17 and out of the slice duct 17 onto a forming wire H. It should be understood that other tube manifolds, turbulence generators, slice duct, etc. can be used in accordance with the teachings of the invention.

Dilution liquid, preferably clean water or fibrous water, is passed from a dilution-liquid inlet header 18 through ducts or flow passages $P_1$ opening into the dilution header in the distribution plate 12*b* to respective valves $20a_1$,$20a_2$ . . . placed in different positions of width of the headbox of the paper/board machine so as to regulate the basis weight of the web. The valves may be arranged to extend across substantially the entire width of the web. From each valve $20a_1$, $20a_2$ . . . , a dilution flow can be passed into a respective narrowing duct $19a_1$,$19a_2$ . . . placed in the distribution plate 12*b*. From each narrowing duct $19a_1$,$19a_2$ . . . , a plurality of ducts $g_1$,$g_2$,$g_3$ are opened into a respective one of the ducts $12a_{1.1}$,$12a_{1.2}$,$12a_{1.3}$, in which connection the dilution liquid is distributed from the narrowing duct $19a_1$ into each pipe in the respective vertical row of the pipes $12a_{1.1}$, $12a_{1.2}$ . . . at the same time and also so that preferably the same amount of dilution liquid is passed into the pipes $12a_{1.1}$,$12a_{1.2}$,$12a_{1.3}$ . . . , $12a_{2.1}$,$12a_{2.2}$,$12a_{2.3}$ . . . in each vertical row concerned.

As shown in FIG. 1A, the dilution-liquid header 18 and the stock header 11 are placed one above the other so that the dilution-liquid and stock distribution spaces are separated from one another by a common partition wall 100, the dilution-liquid space being above the partition wall 100 and the stock distribution space being below the partition wall 100. The partition wall 100 is fixed, for example, by welding to the inlet plate 12*a*. The headbox 10 also includes a frame construction 200, which encloses both the stock distribution space 11 and the dilution-liquid distribution space 18, and is arranged so that it can be pivoted into an open position together with the inlet plate 12*a* by hinge means 300 (the distribution plate 12*b* being maintained in its position during the pivotal movement of the frame construction 200 and inlet plate 12*a*). In this manner, the flow ducts in the inlet plate 12*a* and the flow ducts in the distribution plate 12*b*, both of which are thus exposed by the pivotal separation of the inlet plate 12*a* from the distribution plate 12*b*, can be cleaned. The locking arrangement between the plates 12*a* and 12*b* is also therefore opened or disengaged.

FIG. 1B illustrates the supply of dilution liquid into connection with the headbox 10 through the distributor valve $20a_1$ on an enlarged scale and specifically, the area X of FIG. 1A.

In FIG. 1B, the valve $20a_1$, which regulates the dilution flow $L_1$, is illustrated. By means of the valve $20a_1$, the quantity of dilution liquid $L_1$ coming from the inlet header 18 is regulated. The flow $L_1$ of dilution liquid enters from the inlet header 18 through the duct $P_1$ in the inlet plate 12*a*, a plurality of which are located in the inlet plate 12*a*, and is directed to the respective valve $20a_1$,$20a_2$ . . . A spindle 22 of the valve $20a_1$,$20a_2$ . . . is rotated by means of a regulating motor 25 or other actuation means motively coupled to the spindle 22. The spindle 22 includes a flow duct 23, in this embodiment a curved flow duct, having an inlet opening $A_1$and an outlet opening $B_1$'. By means of the rotation of the spindle, the position of the outlet opening $B_1$' of the flow duct 23 in the spindle 22 is regulated in relation to the flow-duct outlet opening $B_1$ in the valve housing with which the outlet opening $B_1$' is associated. When the flow $L_1$ is maximal, the outlet opening $B_1$' of the flow duct 23 in the spindle 22 coincides completely with the outlet opening $B_1$ in the valve housing 21. Next, the dilution flow $L_1$ enters from the valve $20a_1$ into the narrowing duct $19a_1$ in the distribution plate 12*b*, and from the duct $19a_1$ the flow is passed further through the branch ducts $g_1$,$g_2$,$g_3$ into the pipes $12a_{1.1}$,$12a_{1.2}$ . . . in the vertical row in the distribution plate 12*b* associated with that duct $19a_1$. FIG. 1B also shows that flow duct 23 of the spindle 22 has the shape of a smooth, curved elbow whereby the flow opening $A_1$' is situated on a front face of the spindle 22 and the flow opening $B_1$' is situated on a side face of the spindle 22.

FIG. 1C is a sectional view taken along the line 1C—1C in FIG. 1A. As shown in FIG. 1C, each valve $20a_1$,$20a_2$ . . . placed in different positions of the width of the headbox is arranged to regulate the flow $L_1$ of dilution liquid into the connected narrowing duct $19a_1$,$19a_2$ . . . and, thus, through the respective set of ducts $g_1$,$g_2$,$g_3$ departing from these ducts into the stock distribution pipes $12a_{1.1}$,$12a_{1.2}$ . . . , $12a_{2.1}$,$12a_{2.2}$ . . . of the distribution plate 12*b*.

Figure 2:
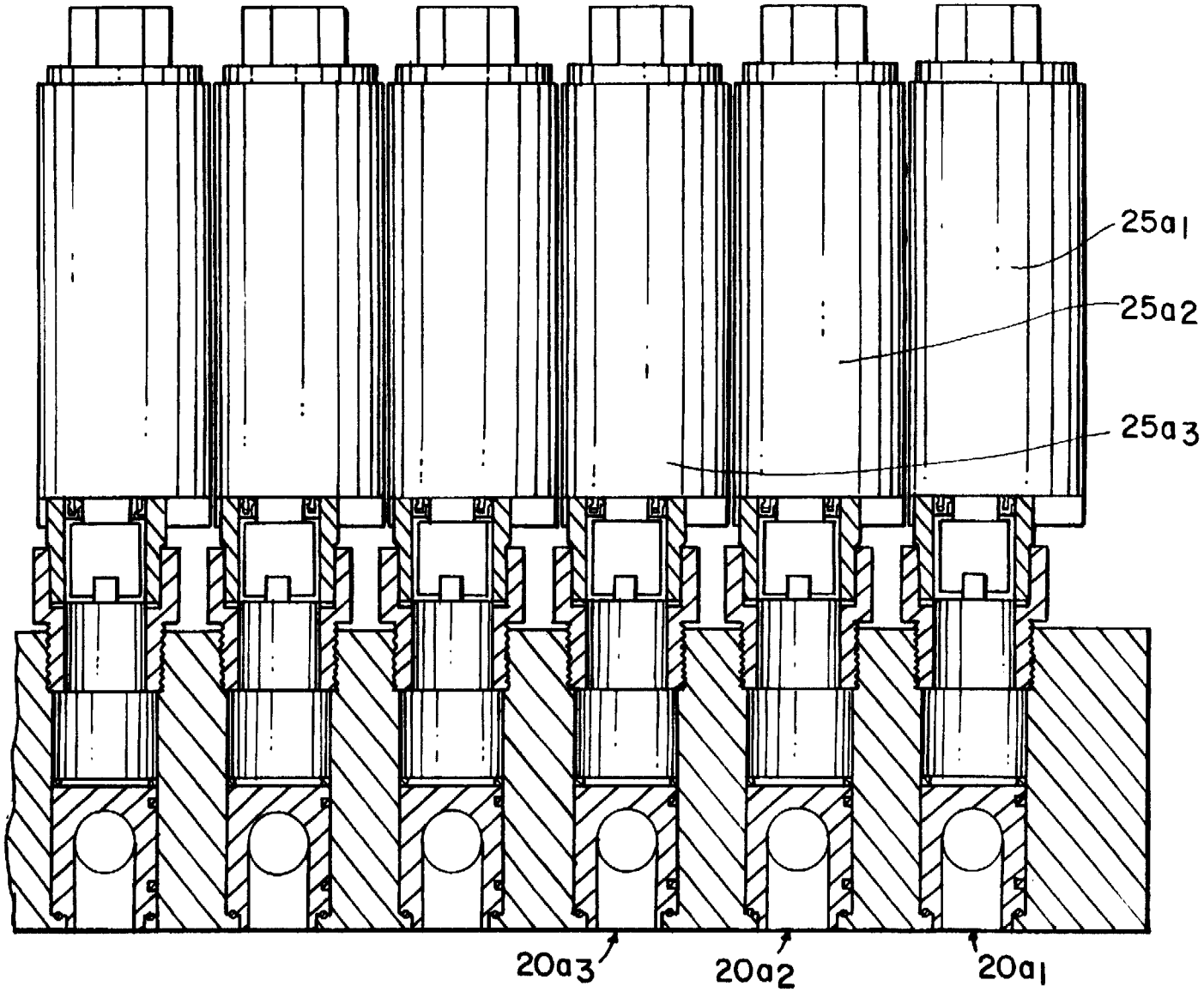
FIG. 2 shows the headbox as shown in FIG. 1A viewed from above and thus the headbox construction as shown in FIG. 1B mainly as a sectional view taken along the line 2—2 in FIG. 1B.

FIG. 2 shows the construction as shown in FIG. 1B from above, mainly along the section line 2—2. As shown in FIG. 2, valves $20a_1$,$20a_2$,$20a_3$ . . . are placed in different positions of width of the headbox of the paper/board machine with a view toward enabling regulation of the basis weight of the web at the desired position of width, e.g., to provide a desired profile.

Figure 3A:
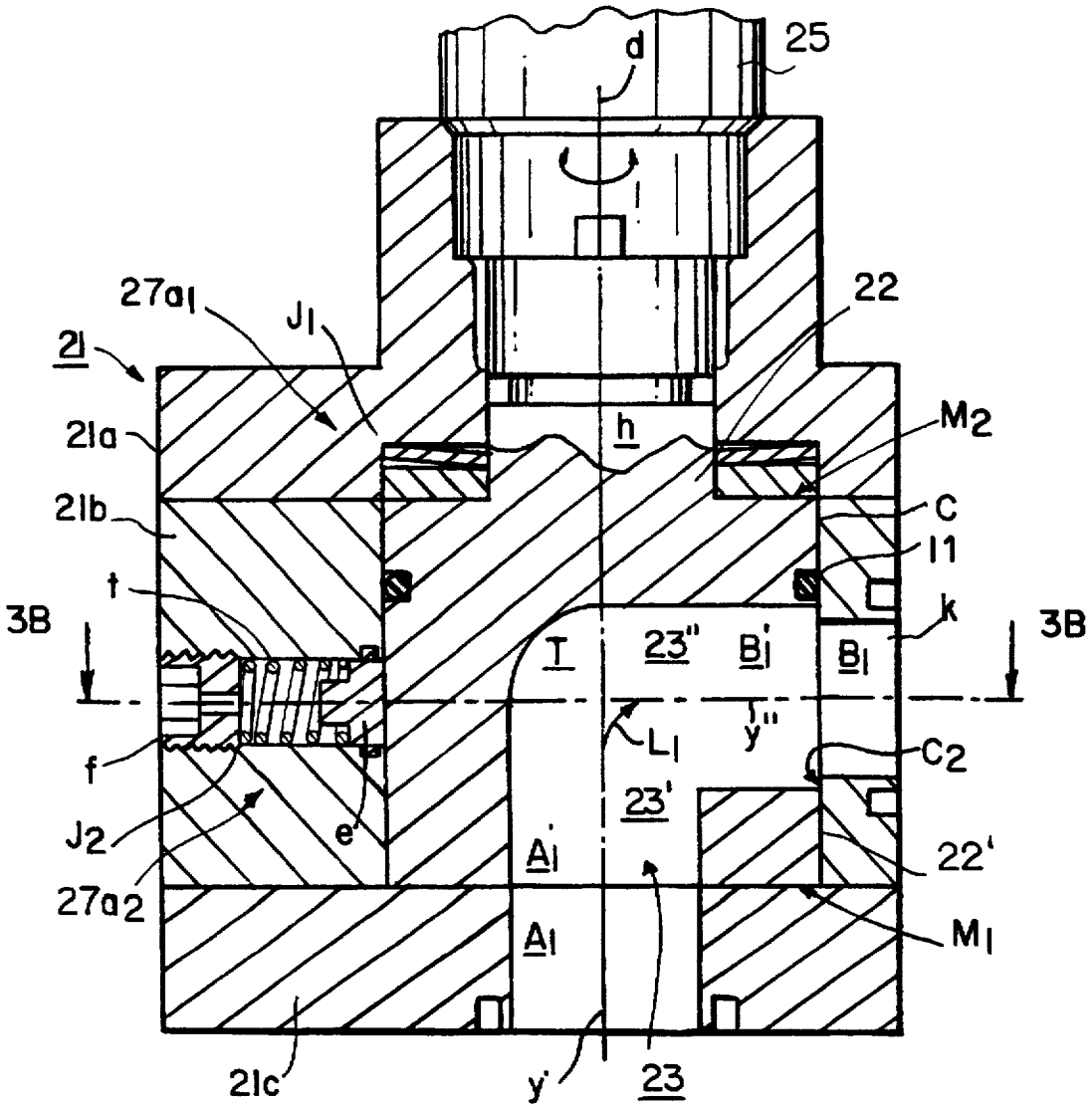
FIG. 3A is a sectional view of a valve in accordance with the invention which regulates the dilution flow.

FIG. 3A is a sectional view of a valve 20 that regulates the flow of dilution liquid. Each valve $20a_1$,$20a_2$ . . . , placed at different positions of width across the headbox, is arranged to regulate the flow $L_1$ of the dilution liquid into the connected narrowing duct $19a_1$,$19a_2$ . . . Thus, the valves $20a_1$,$20a_2$ . . . regulate the flow of the dilution liquid into a respective one of the narrowing ducts $19a_1$,$19a_2$ . . . and the flow of the dilution liquid into the stock distribution pipes $12a_{1.1}$,$12a_{1.2}$ . . . , $12a_{2.1}$,$12a_{2.2}$ . . . communicating with the respective narrowing duct $19a_1$,$19a_2$ . . .

Figure 3B:
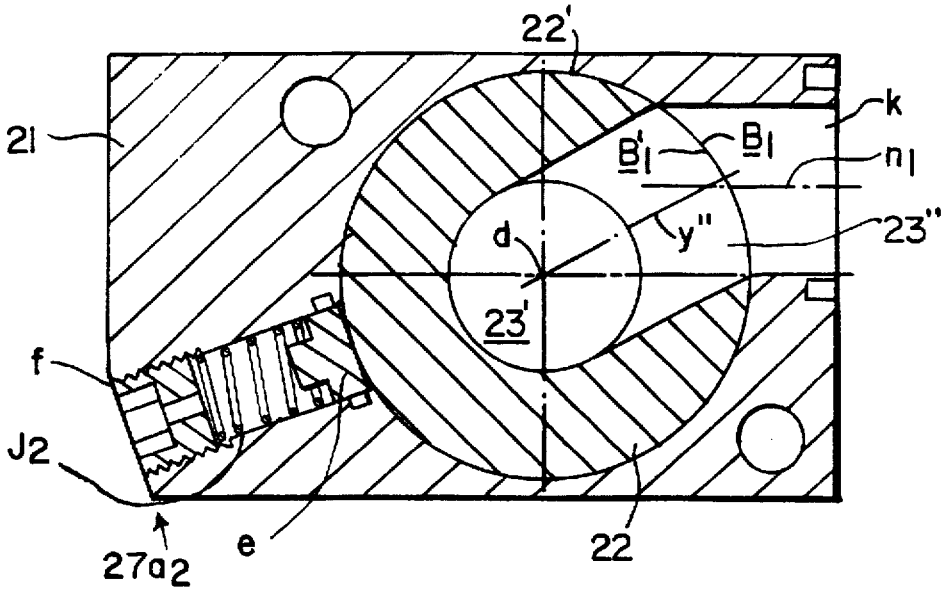
FIG. 3B is a sectional view taken along the line 3B—3B in FIG. 3A.
Figure 3C:
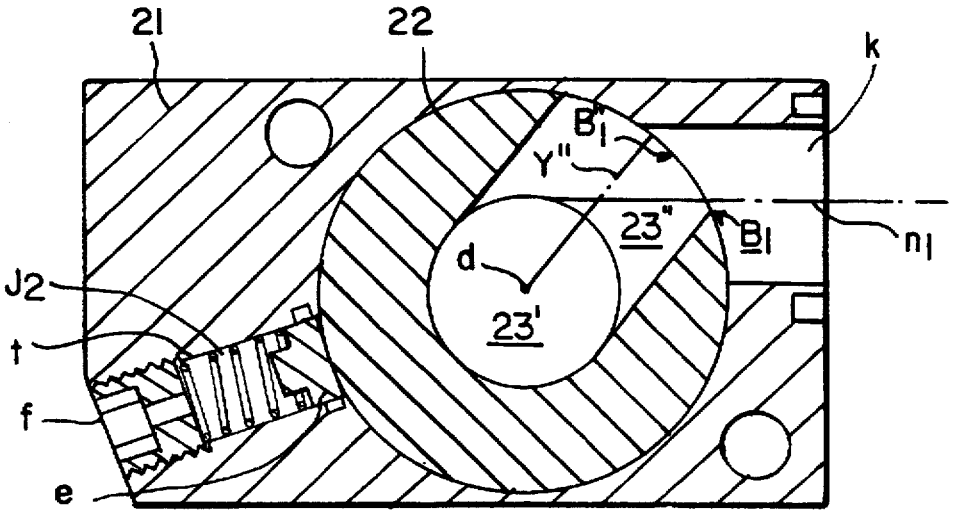
FIG. 3C shows the spindle of the valve in a second flow regulation position.

FIGS. 3A, 3B and 3C show one of the valves $20a_1$, $20a_2$ . . . in greater detail. The valve $20a_1$ comprises a valve housing 21 having an interior, i.e., a spindle cavity C, in which the spindle 22 is placed. The valve housing 21 can be a separate frame construction, or it can consist of the distribution plate 12*b*, i.e., be a part of the distribution plate. Thus, the valves $20a_1$,$20a_2$ . . . can be a separate construction unit, which can be arranged entirely separate from the headbox, or a construction unit as shown in the figures, which can be arranged in such a way in connection with the distribution plate 12*b* that the valve housing 21 of the valve can be arranged in connection with the distribution plate 12*b* into an opening made into the distribution plate. As stated above, the construction can also be such that the valve housing 21 is a part of the construction of the distribution plate 12*b*, in which case just the valve spindle 22 can be placed fitted into the valve housing 21 made of the distribution plate 12*b*. As shown in FIG. 3A, the valve housing 21 comprises valve housing parts 21*a*, 21*b* and 21*c*. The construction can also consist of one single piece, e.g., a cast piece, to which the spindle 22 can be fitted and locked rotatably, e.g., by means of a separate cover plate fixed by screws or equivalent fastening means.

The spindle 22 comprises the duct 23, which is opened both from the end of the valve spindle and from the side face 22' of the cylindrical valve spindle. The duct 23 comprises end openings: a first end opening, i.e., the flow inlet opening $A_1$', and a second end opening, i.e., the flow outlet opening $B_1$'. The duct 23 comprises a curved smooth curve portion T, by whose means the dilution flow $L_1$ is passed smoothly from the dilution-liquid flow inlet opening $A_1$' into its outlet opening $B_1$' placed at the side face 22' of the cylindrical spindle. The valve spindle 22 can be rotated in the valve housing 21 around the longitudinal and central axis (d-axis) of the spindle 22. This rotation of the valve spindle takes place by means of a motor 25 shown in FIG. 3A, preferably an electric motor. The electric motor 25 is preferably a stepping motor. The sectional shape of the flow duct 23 in the valve spindle 22 is preferably a circle, taken perpendicularly to the longitudinal axes Y' and Y" of the flow duct. The longitudinal axis of the flow duct 23 comprises a first longitudinal axis portion Y' which is parallel to the axis of rotation d and coincides with the axis of rotation (duct portion 23'), and a second longitudinal axis portion Y" having a longitudinal axis which is perpendicular to the axis of rotation d (duct portion 23"). The duct portion 23" of the duct 23 is perpendicular to the duct portion 23'.

In order to prevent detrimental flow leakages into the space between the spindle 22 and the spindle cavity C in the valve housing 21, the arrangement comprises loading means $27a_1$,$27a_2$, by whose means the spindle 22 can be pressed tightly against the inlet opening $A_1$ and the outlet opening $B_1$ in the valve housing 21, or more particularly the faces of the spindle cavity in the valve housing against which the sides of the spindle having the inlet and outlet openings are arranged. Advantageously, the loading means $27a_1$,$27a_2$ can be spring means $J_1$,$J_2$ which exert a force directly or indirectly against the spindle 22. It is also possible to use other loading means, such as screws or equivalent. As shown in FIG. 3A, the loading means $27a_2$ are a combination of a spring $J_2$ and a screw f as well as a piston e, in which connection the force is regulated by means of the screw with which the spring $J_2$ presses the spindle 22 by the intermediate of the piston e against the wall $C_2$ of the spindle cavity C in the valve housing 21 placed opposite to the spring $J_2$. The screws, the spring $J_2$, and the mobile piston e are placed in a side bore t in the valve housing 21, which bore is opened into the space C. In this manner, it is possible to provide two separate loading systems, one for pressing the spindle in a first direction against a first face of the spindle cavity such that only the inlet flow opening of the spindle is pressed tightly against an opposed face of the spindle cavity in the valve housing and another one for pressing the spindle in a second direction against a second face of the spindle cavity such that only the outlet flow opening of the spindle is pressed tightly against an opposed face of the spindle cavity.

The sectional shape of the inlet opening $A_1$ of the valve housing 21 is preferably a circle, and so is the shape of the outlet opening $B_1$. The sectional shapes correspond to the sectional shapes of the flow duct 23 at each respective end $A_1$',$B_1$' of the flow duct 23 placed in the spindle 22. The spindle 22 can be rotated by means of an electric motor 25 into different regulation positions. The electric motor is connected to the shaft h of the spindle 22 either directly (FIG. 3A) or through a gearbox (not shown). The end bearings of the cylindrical spindle 22 are denoted by references $M_1$,$M_2$. When the spindle 22 is rotated, the outlet opening $B_1$' of the flow duct 23 in the spindle 22 can be brought into different positions in relation to the outlet opening $B_1$ in the valve housing 22. In this manner, it is possible to regulate the throttle of the flow $L_1$. There is an annular seal $I_1$ between the spindle 22 and the spindle cavity C in the valve housing 21.

In the construction in accordance with the invention, one end opening $A_1$' of the flow duct 23 and the flow opening $A_1$ in the valve housing 21 or equivalent are placed in alignment with one another irrespective of the turning position of the spindle 22. Their position in relation to one another is not changed during regulation. The position of the other end opening $B_1$' of the duct 23 in the spindle 22 in relation to the flow opening B1 in the valve housing 21 or equivalent can be regulated by rotating the spindle 22 to provide different flow quantities of the dilution liquid.

In the construction in accordance with the invention, the inlet opening $A_1$' of the flow duct and the inlet opening $A_1$ in the valve housing 21 have a circular section and substantially equal diameters.

FIG. 3B is a sectional view taken along the line 3B—3B in FIG. 3A. As shown in FIG. 3B, it is seen that the sectional shape of the flow duct 23 is a circle and the sectional shape of the spindle 22 is also a circle. In the embodiment shown in FIGS. 3A,3B and 3C, the spindle is cylindrical, i.e., it has an oblong cylindrical construction. Within the scope of the invention, an embodiment is also possible in which the spindle 22 is a ball, in which case a sectional view of the embodiment is similar to the sectional view of the embodiment shown in FIG. 3B, and the construction is in the other respects fully similar. FIG. 3B shows one end position of regulation, in which the dilution flow $L_1$ is at the maximum. Also, it is seen that the outlet opening $B_1$ of the dilution flow $L_1$ is placed in the valve head 21 eccentrically in relation to the valve construction, so that the central axis $n_1$ of the outlet opening $B_1$ and of the outlet duct k and the central axis Y" of the end 23" of the flow duct 23 in the spindle 22 are placed at an oblique angle in relation to one another.

FIG. 3C shows a second position of regulation, in which the cross-sectional flow area of the passage for the flow $L_1$ has been reduced which results in a reduction of the dilution flow $L_1$. The longitudinal axis Y" of the flow duct portion 23" at the outlet side of the flow duct 23 is placed in an inclined position in relation to the longitudinal axis $n_1$ of the outlet duct k placed in the valve housing or equivalent. When the flow is throttled, the valve is rotated from the open position shown in FIG. 3B counter-clockwise to the obtained the position shown in FIG. 3C. The outlet opening $B_1$ in the valve housing 21 is arranged eccentrically in relation to the construction, in which case, vortex formation is produced in the flow and this serves to keep the valve clean more readily.

The examples provided above are not meant to be exclusive. Many other variations of the present invention would be obvious to those skilled in the art, and are contemplated to be within the scope of the appended claims. For example, the valve disclosed above can be used alone in other contexts for regulating a flow.

I claim:

1. In an arrangement for combining a flow of a dilution liquid from a dilution liquid source with a flow of stock being passed from an inlet header of a headbox of a paper/board machine through at least one conduit to a slice duct, the improvement comprising a valve for regulating the dilution flow, said valve fluidly connecting the dilution liquid source to the at least one conduit through which the stock flow is passed, said valve comprising a valve housing having a first flow opening and a second flow opening and a spindle having a flow duct having a first flow opening and a second flow opening, and rotation means arranged in connection with said spindle for rotating said spindle, said spindle being arranged in said valve housing such that upon rotation of said spindle by said rotation means, said first flow opening of said flow duct in said spindle is continuously in alignment with said first flow opening of said valve housing irrespective of the position of rotation of said spindle in said valve housing and said second flow opening of said flow duct of said spindle is moved into different positions in relation to said second flow opening in said valve housing to thereby result in a variable dilution flow through said valve.

2. The arrangement of claim 1, wherein said first flow opening of said flow duct of said spindle is an inlet opening of the dilution flow and said second flow opening of said flow duct of said spindle is an outlet opening of the dilution flow whereby the dilution flow is directed through said flow duct of said spindle from said first flow opening to said second flow opening, said first flow opening of said flow duct of said spindle being situated in a fixed position relative to said first flow opening in said valve housing, said spindle being rotated by said rotation means about an axis of rotation, said first flow opening of said flow duct of said spindle and said first flow opening in said valve housing each having a central axis coincident with the axis of rotation of said spindle.

3. The arrangement of claim 2, wherein said flow duct of said spindle comprises a smooth, curved elbow whereby said first flow opening of said flow duct of said spindle is situated on a front face of said spindle and said second flow opening of said flow duct of said spindle is situated on a side face of said spindle.

4. The arrangement of claim 1, wherein said rotation means comprise a motor motively coupled to said spindle.

5. The arrangement of claim 1, wherein said spindle is situated in a spindle cavity of said valve housing having internal faces, further comprising loading means operatively associated with said spindle for pressing said spindle against at least one of said faces of said spindle cavity such that said first and second flow openings of said flow duct of said spindle are pressed tightly against a respective opposed one of said faces of said spindle cavity to prevent leakage of dilution liquid between aligned ones of said flow openings of said spindle and said valve housing.

6. The arrangement of claim 5, wherein said loading means comprise first loading means for pressing said spindle in a first direction against a first one of said faces of said spindle cavity such that only said first flow opening of said flow duct of said spindle is pressed tightly against said first face of said spindle cavity by said first loading means and second loading means for pressing said spindle in a second direction against a second one of said faces of said spindle cavity such that only said second flow opening of said flow duct of said spindle is pressed tightly against said second face of said spindle cavity by said second loading means.

7. The arrangement of claim 6, wherein said first loading means comprise a spring structured and arranged to exert a force against said spindle.

8. The arrangement of claim 6, wherein said second loading means comprise a piston part engaging a side face of said spindle, a spring structured and arranged to exert a force against said piston part and a screw for regulating the force being exerted by said spring against said piston part.

9. The arrangement of claim 1, wherein said second flow opening of said flow duct of said spindle and said second flow opening in said valve housing each have a circular cross-sectional shape and a central axis, said spindle being arranged in said valve housing such that said central axis of said second flow opening of said flow duct of said spindle is always at an oblique angle with respect to said second flow opening in said valve housing during flow of a dilution liquid through said flow duct of said spindle.

10. The arrangement of claim 1, further comprising a tube bank situated downstream in a flow direction from said inlet header and including a plurality of horizontally and vertically aligned tubes, a distribution plate interposed between said inlet header and said tube bank and including a plurality of pipes, each of said pipes of said distribution plate being aligned with a respective one of said tubes of said tube bank, said distribution plate including a plurality of narrowing ducts, each of said narrowing ducts being fluidly coupled to a respective vertical column of said pipes in said distribution plate, said narrowing ducts being structured and arranged to distribute a uniform amount of fluid into each of said pipes in the respective vertical column, and a plurality of said valves, said valves being arranged in connection with said distribution plate such that said second flow opening of one of said valves is open toward each of said narrowing ducts.

11. The arrangement of claim 10, further comprising an intermediate flow duct arranged between said second flow opening of each of said valves and the respective one of said narrowing ducts.

12. The arrangement of claim 1, further comprising a dilution header constituting the source of the dilution liquid and arranged to provide the dilution flow, and an inlet plate interposed between said dilution header and said valve, said inlet plate including a pipe fluidly coupled to said dilution header, said first flow opening of said valve being open to said pipe in said inlet plate.

13. The arrangement of claim 1, further comprising a dilution header constituting the source of the dilution liquid and arranged to provide the dilution flow, said dilution header being situated above said inlet header, a partition wall for separating said dilution header from said inlet header such that distribution space for the dilution flow and the stock flow are separated, and an inlet plate connected to said partition wall and interposed between said dilution header and said valve, said inlet header including a pipe fluidly coupled to said dilution header, said first flow opening of said valve being open to said pipe in said inlet plate.

14. The arrangement of claim 1, wherein said first flow opening of said flow duct in said spindle and said first flow opening in said valve housing are circular and have substantially equal diameters.

15. A method for adjusting a stock flow in a headbox of a paper/board machine, comprising the steps of:

passing the stock flow from an inlet header through pipes in a distribution plate, directing the dilution flow from a dilution header through a valve into the pipes through which the stock flows passes in the distribution plate, and regulating the dilution flow by rotating a spindle in a housing of the valve such that an inlet flow opening of a flow duct in the spindle is continuously in alignment with an inlet flow opening of the valve housing irrespective of the position of rotation of the spindle in the valve housing and an outlet flow opening of the flow duct of the spindle is moved into different positions in relation to an outlet flow opening in the valve housing.

16. The method of claim 15, further comprising the step of:

preventing leakage in the valve by pressing the spindle against at least one face of a spindle cavity in the valve housing in which the spindle is situated such that the flow openings of the flow duct of the spindle are pressed tightly against a respective opposed face of the spindle cavity.

17. The method of claim 15, further comprising the steps of:

arranging a plurality of valves to extend across substantially the entire width of the headbox, and regulating the basis weight profile of the stock flow in the headbox in a direction transverse to the direction of stock flow by regulating the dilution flow through each of the valves.

* * * * *